United States Patent [19]

Mayerhoffer

[11] 4,244,990

[45] Jan. 13, 1981

[54] PROCESS FOR THE PRODUCTION OF A MELAMINE RESIN COATED PAPER

[75] Inventor: Herbert Mayerhoffer, Vienna, Austria

[73] Assignee: Osterreichische Haig-Werke Aktiengesellschaft, Vienna, Australia

[21] Appl. No.: 35,659

[22] Filed: May 3, 1979

[30] Foreign Application Priority Data

| | | | |
|---|---|---|---|
| May 3, 1978 | [AT] | Austria | 3233/78 |
| Jul. 12, 1978 | [AT] | Austria | 5035/78 |
| Nov. 23, 1978 | [AT] | Austria | 8386/78 |

[51] Int. Cl.[3] ..... B05D 3/02; B05D 1/28; B32B 27/08; B32B 27/42

[52] U.S. Cl. ..... 427/211; 427/377; 427/382; 427/391; 427/411; 427/428; 428/530

[58] Field of Search ..... 427/365, 366, 377, 378, 427/382, 211, 391, 411, 428; 428/530

[56] References Cited

U.S. PATENT DOCUMENTS

| | | | |
|---|---|---|---|
| 3,455,733 | 7/1969 | Lloyd et al. | 427/382 |
| 3,458,465 | 7/1969 | Rehnelt et al. | 428/530 X |
| 3,520,715 | 7/1970 | Meiser | 428/530 X |
| 4,083,743 | 4/1978 | Degens | 428/530 X |
| 4,158,713 | 6/1979 | Degens | 428/530 X |

*Primary Examiner*—Michael R. Lusignan

*Attorney, Agent, or Firm*—Sughrue, Rothwell, Mion, Zinn and Macpeak

[57] ABSTRACT

The invention relates to a process for the production of a melamine resin coated paper for the formation of hot-molded, scratch resistant surface layers on laminate synthetic substances and wooden working materials, whereby the paper is preimpregnated with a urea resin or an aminoplast rich in urea and is then provided with an application of a melamine resin. At the same time, a solution of a resin is used for the preimpregnation of the paper, the degree of condensation of which is higher than the degree of condensation of the melamine resin to be used for the formation of the cover layer, and the preimpregnation is dried hot, to an extent that the preimpregnation resin is hardened to the point it is practically no longer soluble in the melamine resin.

17 Claims, No Drawings

PROCESS FOR THE PRODUCTION OF A MELAMINE RESIN COATED PAPER

BACKGROUND OF THE INVENTION

1. Field of the Invention

The invention relates to a process for the production of a melamine resin coated paper for the formation of hot pressed, scratch resistant surface layers on laminate synthetics and wooden working materials, such as wood fiber boards, wood chipboards, plywood or similar materials, whereby the paper is preimpregnated with a urea resin which is water soluble in its still unhardened state or with an aminoplast rich in urea and which is water soluble in the still unhardened state, is dried and is provided furthermore at least on one side with an application of a melamine resin which is water soluble in the unhardened state which is also dried and which in the course of the hot pressing process in the case of which the paper is combined with the substrate surface to be coated, will form a cured, scratch resistant chemically constant closed surface layer while flowing.

2. Description of the Prior Art

Melamine resin coated papers, the melamine resin coating of which in the course of the hot pressing process in case of which the paper is connected with the substrate surface that is to be coated, will form a hardened surface layer while flowing. They are widely used for the production of surface coatings, whereby they are used above all in connection with layered molding substances which are built up from phenol resin paper, as well as for the production of cover layers or wood fiber boards and wood chipboards, whenever decorative surface layers are to be created. By the use of such melamine resin coated papers, one will obtain surface layers which are easily scratch resistant as against the customary stresses which occur in the household or in the office and are also capable of easily withstanding the thermal or chemical strains occurring in this area. In this connection, we may mention that various other papers and foils are used for the surface coating, the surface of which will suffer from such stresses and which are considerably inferior especially in regard to the scratch resistance of the surface layers produced on the basis of melamine resin coated papers.

The use of the melamine resins which, as has been mentioned, results in surfaces capable of dealing with a high stress and which moreover, because of the extraordinary optical characteristics of these resins, offers advantages, does represent a considerable cost factor in the case of the production of the coated papers. A substitution of the melamine resins by urea resins, which are available at a more favorable price and which likewise have good optical characteristics, encounters great difficulties as a result of the sensitivity to moisture of hardened urea resins. In the case of use of mixtures of urea resins and melamine resins for the production of surface layers of the type in question here, it will result in an important drop in quality as compared to surface layers which are formed on the basis of pure melamine resins.

In order to substantially lower the costs for the resin in the case of the production of melamine resin coated papers while maintaining the cover layers made of pure melamine resin, known proposals have provided for subjecting the papers first of all to a preimpregnation with a urea resin or with a urea-melamine mixed resin and to equip the papers impregnated thus subsequently with cover layers of melamine resin. In that case, the problem arises that one must effectively counteract a diffusion of the urea resin in the melamine resin cover layer, in order to restrain a deterioration of the quality of the cover layer. Difficulties resulted both in regard to this problem as well as in regard to the processes of saturation or coating and drying of the paper that was to be coated during the practical execution of the known processes. This militated against the general introduction of these processes, whereby frequently a strong tendency for the intermixing of the impregnation resin with the melamine resin cover layer was exhibited.

SUMMARY OF THE INVENTION

An object of the present invention is to create a process of the above mentioned type where the preimpregnation will result in a substantial saving of cover layer resin and where the danger of a diffusion of the preimpregnation resin into the cover layer has also been eliminated. At the same time, a possibility of carrying out the saturation processes quickly and without problems is to be guaranteed.

The process according to the invention comprises preimpregnating of paper with a solution of a urea resin or of an aminoplast rich in urea resin (hereinafter collectively "resin" or urea "resin"), with the degree of condensation of the resin or the aminoplast being higher than that of a water-soluble melamine resin to be applied for the formation of cover layer(s), thereon and with the absorption of the resin or aminoplast being kept lower than it is required for the development of a film of resin or aminoplast covering the surface of the paper, hot drying of the preimpregnated paper until the preimpregnated resin applied to the paper has been hardened at least to such a point that the resin or aminoplast is practically no longer soluble in a coating solution of the melamine resin to be applied applying a coating solution of the melamine resin thereto, and then drying the paper after the application of the melamine resin to a residual moisture lying between 5 and 10%.

DETAILED DESCRIPTION OF THE INVENTION

As a result of the measures according to the invention, the previously cited objects may be well met and one may obtain surface layers with this paper, the characteristics of which equal surface layers which are obtained with the use of paper coated merely pure melamine resin. In that case, it is particularly remarkable that in the case of the hot pressing process where a flow of the melamine resin takes place, neither a shifting of the urea resin located in the paper to the melamine resin coated surface occurs, nor do any diffusions of bonding of the melamine resin cover layers on the paper substrate appear, since the melamine resin reaches into the fiber structure of the paper and consequently the melamine resin cover layer which determines the characteristics of the surface layers produced with regard to scratch resistance as well as with regard to chemical and thermal stability is fortified by the fiber structure of the paper so that a possibly existing brittleness of melamine resins will have no disadvantageous effect. As a result of the higher degree of condensation of the preimpregnation resin provided, a quick, prehardening of this resin may be achieved during the drying process.

With regard to the difference of the degree of condensation between the preimpregnation resin and the cover layer melamine resin, we understand in this case thereby that the viscosity of a solution of the preimpregnation resin which has the same concentration of resin and the same temperature as the comparative solution of the cover layer melamine resin, is greater than the viscosity of the latter.

The danger of an intermixing of the urea resin or of the aminoplast rich in urea of which the preimpregnation of the paper consists, with the melamine resin serving for the formation of the cover layers, is met effectively through the fact that the preimpregnation resin consisting of a urea resin or of an aminoplast rich in urea is hardened at least to such a point that it is practically no longer soluble in a coating solution of the melamine resin applied.

As a result of the latter measure, just as a result of the higher degree of concentration of the impregnation resin, a shifting of the preimpregnation resin into the melamine resin cover layer is countered. Also the quantity of resin required for the cover layers is decreased, since in that way any absorption of the melamine resin into the inside of the paper will be largely eliminated in the course of the hot pressing process.

It is favorable, whenever provisions are made in the case of the process according to the invention that in the course of the hot drying succeeding the preimpregnation and which preferably is carried out by means of hot air, the moisture of the paper is lowered to a value lying below 7%. Preferably, at the same time in the case of hot air drying, the paper saturated with the preimpregnation resin is dried to a residual moisture lying between 2 and 6%.

The hot air drying which, as is known per se, may be carried out by conducting the quickly running paper web through a drying channel, results in an advantageous development of the desired hardening of the preimpregnation resin as of the drying is continued, whereby as a result of the water content the temperature is adjusted automatically which is favorable for the prehardening of the preimpregnation resin.

It is also possible to carry out the drying following the preimpregnation by means of radiation heat, whereby the drying may be finished at a higher residual moisture than in the case of the hot air drying, since the radiation action on the side facing the radiator additionally promotes the hardening of the preimpregnation resin. In that case preferably, one would provide a drying to a moisture of 16% or less; a preferred area lies between 10 and 13% of moisture.

It is furthermore effective that the paper is dried in the second drying process which follows the application of the melamine resin to a residual moisture lying between 6 and 8%.

Preferably, a resin solution with at least a 45% by weight of solid resin is used for the preimpregnation of the paper as a result of which a good filling of the paper and at the same time a very economic drying of the preimpregnation results. Both advantages appear especially in the case of working with a resin solution which contains between a 48 and 55% by weight of solid resin.

Whenever the saturation process of the preimpregnation is to be promoted, then it is advantageous especially whenever a paper with low absorbency is processed, if the concentration of the preimpregnation solution depending on the type of paper to be coated, is adjusted to a solid resin content lying between 20 and 45, preferably between 35 and 45% by weight. A working with a solution which contains between 35 and 45% by weight of solid resin will result at the same time and in a simple manner in a quantitatively good absorption of resin of the paper.

In order to obtain an as clearly as possible defined condensation and hardening process for the preimpregnation, one should advantageously use a pure urea-formaldehyde condensate for the preimpregnation.

However, for the preimpregnation, a urea-formaldehyde condensate mixed with melamine resin may also be used, whereby the degree of condensation of the urea formaldehyde condensate still free of melamine resin is higher than that of the melamine resin.

If desired however, one may also use for the preimpregnation, a urea resin mixed with plasticizing agents such as f. ex., caprolactam, sucrose, glycols, polyhydroxy compounds, etc., or an aminoplast rich in urea.

In the case of the use of an impregnation resin solution with a solid resin content of more than 45% by weight and especially between 48 and 55% by weight, advantageously the ratio of the quantity of the resin applied for the preimpregnation in relation to the quantity of the melamine resin application provided for the formation of the cover layer and in the case of an application of the cover layer on both sides, is selected between 2:3 and 3:1, preferably between 55:45 and 65:35. If, on the contrary, a preimpregnation resin solution with a solid resin content between 20 and 45% by weight, especially between 35 and 45% by weight, is used, then this quantitative ratio will advantageously be selected between 1:2 and 3:2, preferably between 5:6 and 6:5.

With regard to the prehardening, it will be advantageous, whenever the hardener added to the preimpregnation resin has a high response temperature. It may also be mentioned that the quantity of hardener in the case of the technique according to the invention is not critical and that one may also use, without any disadvantage, quantities of hardeners which are higher than usual.

The application of the preimpregnation resin and the application of the coating of melamine resin may be accomplished by means of applicator rolls or by submersion, and at the same time one may possibly undertake, after each application process, a squeezing off or wiping off of excess resin.

It has turned out to be favorable to accomplish the application of the preimpregnation resin by moistening by means of applicator rolls and subsequent submersion of the paper web wiping off or sequeezing off of the excess resin and to accomplish the application of melamine resin onto the dried paper saturated with urea or aminoplast rich in urea by means of applicator rolls or filter scrapers.

For the application of particularly thin layers of melamine resin, one may use advantageously screen rolls. At the same time, we may also mention that the difference resulting from the use of papers with differently strong absorbency is much lower in the cost factor required for the resin in the case of use of the technique according to the invention, than it was hitherto, since indeed, the urea resin being applied for the preimpregnation of the paper has a considerably more favorable price than the melamine resin and the preimpregnation largely compensates for the differences in absorbency between the various types of paper and consequently the melamine resin application practically only forms surface layers.

In the case of process according to the invention, one may provide a cover layer of melamine resin on both sides in which case the melamine resin application located on one side of the paper also serves for the connection of the paper forming the surface with the substrate, and in this case is hardened in the course of the hot pressing process.

However, it is also possible to provide a melamine resin application only on one side of the paper and to connect the paper by means of an adhesive with the substrate. This adhesive may be a hot hardening glue which is applied onto the substrate to be coated with the paper. However, it is also possible to apply a hot hardening adhesive onto the paper on the side of the paper opposite the side containing the coating of melamine resin.

The following examples are to explain the invention in more detail.

EXAMPLE 1

A white, decorative paper with a weight per unit area of 100 g/m$^2$, an ash content of 40% by weight, an air permeability of 350 ml/min (standard test), a suction head according to Klemm of 32 mm, a smoothness according to Bekk, on the reverse side of 40 sec., and on the topside of 60 sec., was provided lying tightly over an applicator roll submerging in a resin bath with an application of resin; this application of resin was absorbed in the continued running track of the paper into the paper and the paper was then conducted through two squeezing off rolls, whereby the quantity of resin which was present after leaving the squeezing rolls in the paper, was adjusted by the adjustment of the mutual pressure of the squeezing rolls and by the adjustment of the running speed of the paper. In this way, the paper was saturated with a solution of a commercial urea-formaldehyde condensate which had a solid resin content of 51.5% by weight and a viscosity of 19 DIN sec (4 mm discharge nozzle), had a molar ratio of 1:2.1 and contained ammonium chloride as a hardener. In this case, after passing through the pair of squeezing rolls, the saturated paper had a weight of 240 mg/m$^2$ and consequently contained 140 g of a resin solution per m$^2$ with a resin content of 50% by weight, therefore, 70% by weight of solid resin, based on the weight of the raw paper.

After leaving the squeezing rolls, the paper web was guided in a floating manner through a hot air channel in which a number of hot air registers were disposed, whereby the temperature of the hot air was adjusted to about 160° C. In the course of this drying, the water contained in the paper web was removed to a residual moisture of about 4%. Thus, the paper was largely filled with urea resin and the urea resin showed such a prehardening, that it was practically no longer soluble in the melamine resin solution provided for the subsequent application of the cover layer. After that the paper web, preimpregnated in such a way with the water soluble urea resin, was guided in a tightened state over two applicator rolls and in that way an aqueous melamine resin solution with a resin content of 52.6% by weight and a viscosity of 16 DIN (4 mm discharge nozzle) was applied on both sides of the paper web. In that case, we dealt with an aqueous solution of a commercial melamine resin intended for a high pressure pressing of paper laminates, which was mixed with a hardener on the basis of p-toluene sulfonic acid morpholine. In this case, 26 g of resin solution was applied per m$^2$ on one side of the running paper web and on the other side 58 g per m$^2$ of this resin solution. After that, the paper again was conducted through a drying channel in which the moisture was removed to a residual moisture of 7%. The paper obtained thus had a total coat of 50 g of melamine resin/m$^2$.

EXAMPLE 2

In an analogous manner to Example 1, however, the paper was again unrolled after the first drying process and was stored for a longer period of time until the coating with melamine resin. No sticking together of any kind etc. occurred which would have disturbed the succeeding melamine resin coating.

EXAMPLE 3

A strongly absorbent decorative paper with a weight per unit area of 120 g/m$^2$ was saturated in an analogous manner to Example 1 with a solution of a commercial urea-formaldehyde resin varnish with a mole ratio of 1:1.9, which had a resin content of 50% by weight. This resin varnish had a viscosity of 17 DIN sec (4 mm discharge nozzle) and an addition of 3% by weight of ethylene glycol and to be sure mixed with ethanolamine hydrochloride as a hardener (1% of mass related to the solid resin). The impregnation was adjusted in such a way that the paper upon leaving the squeezing rolls, had a weight per unit area of 360 g/m$^2$. Consequently, the paper upon leaving the squeezing rolls had 100% by weight of solid resin related to the weight of the raw paper. Then the paper web was conducted through an arrangement of infrared radiators for the purpose of drying and as a result of the heat supply brought about in such a way and by a subsequent conduction through a short, hot air channel, the paper was thereby dried to a residual moisture of 5%. Subsequently to that, the paper web was conducted through an impregnating tank in which there was a solution of a commerical melamine low pressure resin containing 52.5% by weight of solid resin, as used for short cycle pressing without recooling. This resin solution had a viscosity of 15.5 DIN sec (4 mm discharge nozzle). After leaving the impregnation tank, the paper web was conducted via the stripping bars and squeezing off rolls, and at the same time the quantity of melamine resin solution absorbed by the paper was adjusted to 103 g/m$^2$. Subsequently, the paper web was dried in a hot air channel to a residual moisture of 7.5%.

EXAMPLE 4

A white, decorative paper with a weight per unit area of 95 g/m$^2$, an ash content of 36% by weight, a suction head corresponding to Klemm of 26 mm, a smoothness according to Bekk on the reverse side of 40 sec and on the topside of 70 sec as well as an air permeability of 260 l/min (standard test) was provided from the underside with an application of resin, whereby the application of resin was accomplished by way of an applicator roll submerged in a resin bath and the paper was then guided floating over the resin bath. Subsequently, the paper web was submerged into the resin bath, was guided by way of squeezing off rolls and finally reached the drying channel. The resin bath consisted of a solution of a commercial urea-formaldehyde condensation product with a mole ratio of 1:2.2, which has been diluted to a solid resin content of 22.5% by weight and which contained as a hardener ethanolamine hydrchloride. The resin bath adjusted thus had a viscosity of 12.2 DIN sec (4 mm discharge nozzle). As a result of this adjustment, it was guaranteed that in the case of a feeder speed of the paper web of 26 m/min from the point of the application of the resin through the applicator roll up to the submersion of the paper into the resin bath, a complete penetration into the paper could take place. By adjusting the mutual contact pressure of the squeezing off rolls, the impregnated paper prior to drying had a weight of 255 g/m$^2$, that corresponds to an impregnation of 37.9% by weight of solid resin originating from the application of resin, based on the weight of the running paper. The impregnated paper web was conducted floating through a hot air channel and was dried at a hot air temperature of about 155° C. to a residual moisture of 3.5%. The paper was now impregnated with a urea resin and the impregnation resin had a prehardening degree which made it practically insoluble in the subsequent melamine resin solution provided as an application for the cover layer. The paper web was then guided across another resin application arrangement in which it was provided on both sides with an aqueous solution of a commercial melamine-formaldehyde-condensation product. This solution was adjusted to a solid resin content of 50% by weight, at the same time it had a viscosity of 14.8 DIN sec (4 mm discharge nozzle) and contained additionally a hardener, p-toluene sulfonic acid morpholine, a wetting agent and a release agent. This application of covering resin was adjusted such that after passage through an additional drying channel, there was a melamine resin application of 67 g of solid resin/m$^2$. The drying in a second drying channel was accomplished in such a way that a residual moisture in the finished paper film of 7.3% resulted ultimately.

EXAMPLE 5

A decorative paper with a weight per unit area of 120 g/m$^2$, a suction head according to Klemm of 28 mm and an ash content of 28% by weight was preimpregnated with an aqueous solution of a urea-formaldehyde-resin varnish with a mole ratio of 1:2.05. The solution of the preimpregnation varnish was adjusted at the same time to a solid resin content of 41.5% by weight and contained ammonium chloride as a hardener. The viscosity of the solution of the preimpregnation resin amounted to 14.5 DIN sec (4 mm discharge nozzle). The preimpregnating apparatus was adjusted such that in the case of a paper feed of 23 m/min, the resin penetrated completely into the paper and after passage through a hot air drying channel in which the impregnated paper web was dried to a residual moisture content of 4.5%, there was a weight of the preimpregnated and dried paper film of 195 g/m$^2$. This corresponded to a resin application of 55% by weight of solid resin, based on the weight of running paper. After that, the preimpregnated paper film was provided with an application on both sides of a solution of a commerical melamine resin having a 54% by weight solid resin which contained, beside the hardening additive customary for short cycle pressing without recooling, additionally a wetting and a release agent. This resin solution had a viscosity of 16.5 DIN sec (4 mm discharge nozzle). The paper web was then subjected again to a hot air drying to a residual moisture of 7.2% and finally had a melamine resin application of 65% by weight, related to the mass of the running paper.

EXAMPLE 6

A decorative paper with a weight per unit area of 75 g/m$^2$, an ash content of 29% by weight, a smoothness of 60 sec (according to Bekk), a suction head according to Klemm of 30 mm and an air permeability of 250 ml/min, was preimpregnated with a formaldehyde-urea-melamine condensate product with a mole ratio of 2.3:0.85:0.15. For this purpose, the impregnation solution of the preimpregnation resin was adjusted to a solid content of 35% by weight and it had at the same time a viscosity of 13.5 DIN sec (4 mm discharge nozzle). In order to guarantee a degree of prehardening of the preimpregnation resin, which makes the dissolving of the preimpregnation resin in the succeeding melamine resin practically impossible, said solution of the preimpregnation resin contained a hardening addition of 0.6% by weight of ethanolamine hydrochoride, related to solid resin, and the impregnated paper web was dried to a residual moisture of 4.2% in a hot air drying channel. After leaving the first drying channel, the preimpregnated paper film had a resin application of 57% by weight of solid resin of the preimpregnation resin. The paper, thus preimpregnated, was now provided with an application of cover resin of an aqueous solution of a commercial melamine resin with a solid resin content of 50.5% by weight, which contained the customary additions of hardener, wetting and release agent, in such a way that 31 g of solid resin/m$^2$ was applied onto the side of the paper serving as the outside layer after the succeeding molding and of 10 g of solid resin/m$^2$ onto the side of the paper serving as an adhesive layer. This melamine resin solution had a viscosity of 15 DIN sec (4 mm discharge nozzle). After the application of the melamine resin serving as the cover layer, the paper web was dried again and at the same time adjusted to a residual moisture of 7.0%.

EXAMPLE 7

A white, decorative paper which had a weight per unit area of 100 g/m$^2$, an ash content of 32% by weight, a suction head according to Klemm of 30 mm and a smoothness of 70 sec (according to Bekk), was preimpregnated with a solution of a urea-formaldehyde-resin varnish containing 38.5% by weight of solid resin. The solution of this preimpregnation resin contained a hardener, an aminohydrochloride, and had a viscosity of 15 DIN sec (4 mm discharge nozzle). With a paper feed speed of 20 m/min, the preimpregnation arrangement was adjusted such that the resin penetrated completely into the paper, and the paper after leaving the preimpregnation had absorbed 40% by weight of solid resin. The preimpregnated paper was now conducted between two radiation dryers with a heating capacity of 180 kW disposed on both sides of the paper web. At the same time a drying to a residual moisture content of 12% took place. As a result of this drying, a prehardening of the preimpregnation resin took place which went so far that the preimpregnation resin was practically no longer soluble in the melamine resin solution provided for the succeeding coating. The preimpregnated paper was then conducted through a solution of a commercial melamine resin with a solid resin content of 52.5% of mass and the customary additives of hardeners, wetting and release agent, was subjected subsequently to a hot air drying and at the same time was dried to a residual moisture of 7%. This melamine resin solution had a viscosity of 15.5 DIN (4 mm discharge nozzle). The paper finally had a melamine resin coating of 70% by weight, based on the mass of the running paper, on both sides.

EXAMPLE 8

In a manner analogous to Example 6, a melamine resin coating was applied after the drying of the preimpregnation merely on one side of the paper film, namely on that side of the paper serving as the outside layer after the molding. In this case again, a resin application of 31 g of solid resin/$m^2$ was provided and afterwards the paper web was dried to a residual moisture of 7%. The paper film obtained thus was hot molded onto a wood chipboard provided with a layer of glue and at the same time both this layer of glue as well as the application of melamine resin located on the paper was hardened in the course of this hot molding process. In this case a hot hardening urea glue previously diluted with rye flour (degree of dilution 200; 100 parts of urea glue resin, 100 parts of rye flour, 100 parts of water) which contained ammonium chloride as a hardener, was applied to the wood chipboard.

The melamine resin coated papers obtained according to Examples 1 to 7 were finally pressed in the customary hot molding technique onto a support and afterwards were subjected to evaluations customary for the determination of the surface quality of molded melamine resin surfaces. Analogously, the surface obtained according to Example 8 was examined. In that case, the customary tests, especially steam test, fissure test, pot test, hardening test, yellowing test, tests for the determination of the scratch resistance, of the constancy of the chemicals and of the degree of luster as well as tests for the determination of whether or not a sufficiently closed surface exists, were made. In this case, it turned out that the characteristics of melamine resin surfaces as they were produced with the use of the papers obtained as described in the previous passages, corresponded completely to the characteristics which exist in the case of melamine resin surfaces which were produced with the use of papers which were impregnated only with pure melamine resin. Particularly, it was also found that the surfaces produced with the papers developed according to the invention satisfied the requirements of DIN 53799.

What is claimed is:

1. A process for the production of a melamine resin coated paper for formation of hot pressed, scratch resistant surface layers on laminated synthetic and wooden materials comprising (1) impregnating a paper by coating such with a solution of a resin selected from the group consisting of (a) a urea resin which is water-soluble in a still unhardened state, and (b) an aminoplast rich in ureas and water-soluble in the still unhardened state;

(2) hot drying the impregnated paper;

(3) coating on at least one side of the impregnated paper a solution of a melamine resin which is water-soluble in the unhardened state, and then (4) hot drying the melamine coated resin paper to a residual moisture content between 5 and 10% by weight; where the degree of condensation of said resin used in (1) is higher than that of said melamine resin used in (3) and where the adsorption of said resin by said paper (1) is kept lower than is required for formation of a resin film covering the surface of said paper and where said hot drying (2) is to an extent that said resin impregnating said paper has been hardened at least to a point that it is substantially no longer soluble in said coating solution of said melamine resin used in (3).

2. The process of claim 1, wherein the hot drying (2) is using hot air and the moisture content of the paper is reduced to a value below 7% by weight in said hot drying (2).

3. The process of claim 1 or 2, wherein in the hot drying (2), the paper is dried with hot air to a residual moisture content between 2 and 6% by weight.

4. The process of claim 1, wherein the hot drying (2) is accomplished by means of radiation and is to a moisture content of 16% by weight or less.

5. The process of claim 4, where the drying (2) is to a moisture content between 10 and 13% by weight.

6. The process of claims 1 or 2, where the paper in the hot drying (4) is dried to a residual moisture content of between 6 and 8% by weight.

7. The process of claim 1 or 2, where the solution of the resin in (1) contains between 20 and 55% by weight of solid resin.

8. The process of claim 7, where the solution contains between 35 and 45% by weight of solid resin.

9. The process of claim 1, where the solution contains between 48 and 55% by weight of solid resin.

10. The process of claim 1 or 2, where the solution of melamine resin in (3) additionally contains a urea-formaldehyde condensate, with the degree of condensation of the urea-formaldehyde condensate being higher than that of the melamine resin.

11. The process of claim 1 or 2, where the solution of the resin in (1) additionally contains a plasticizing agent selected from the group consisting of caprolactam and a polyhydroxy compound.

12. The process of claim 11, wherein the polyhydroxy compound is a polyhydric alcohol, sucrose or a glycol.

13. The process of claim 1 or 2, where the process includes in (3) coating said solution of melamine resin on both sides of said impregnated paper and when the solid resin content of the solution of resin in (1) is below 45% by weight, the ratio of the amount of said resin coated in (1) to the amount of said melamine resin coated in (3) is between 1:2 and 3:2, on a solid resin basis.

14. The process of claim 13, wherein said ratio is between 5:6 and 6:5.

15. The process of claim 1 or 2, where the process includes coating said solution of melamine resin in (3) on both sides of said impregnated paper, and when the solid resin content of the solution of said resin in (1) is above 45% by weight, the ratio of said amount of resin coated in (1) to the amount of said melamine resin coated in (3) is between 2:3 and 3:1.

16. The process of claim 15, wherein said ratio is between 55:45 and 65:35.

17. The process of claim 1 or 2, wherein the process includes additionally providing a heat hardening adhesive layer on one side of said paper.

* * * * *

UNITED STATES PATENT AND TRADEMARK OFFICE

CERTIFICATE OF CORRECTION

PATENT NO. : 4,244,990

DATED : Jan. 13, 1981

INVENTOR(S) : Herbert Mayerhoffer

It is certified that error appears in the above—identified patent and that said Letters Patent is hereby corrected as shown below:

Delete "[73] Assignee: Osterreichische Haig-Werke Aktiengesellschaft, Vienna, Australia"

and insert therefor

--[73] Assignee: Osterreichische Hiag-Werke Aktiengesellschaft, Vienna, Austria--

Signed and Sealed this

*Thirteenth* Day of *October 1981*

[SEAL]

*Attest:*

GERALD J. MOSSINGHOFF

*Attesting Officer*

*Commissioner of Patents and Trademarks*